United States Patent [19]

Sumner et al.

[11] 4,302,202

[45] Nov. 24, 1981

[54] TEXTILE TREATING COMPOSITION AND METHOD OF USE THEREOF

[75] Inventors: Jeffery L. Sumner, Raeford, N.C.; Arthur L. Tinsley, Taylors, S.C.

[73] Assignee: Northwestern Laboratories, Inc., Greenville, S.C.

[21] Appl. No.: 82,578

[22] Filed: Oct. 9, 1979

[51] Int. Cl.[3] ..... D06P 1/56; D06P 5/12; D06P 1/39; D06P 3/852

[52] U.S. Cl. ..... 8/455; 8/531; 8/552; 8/560; 8/609; 8/589; 8/929

[58] Field of Search ..... 8/552, 560, 608, 589, 8/613, 455, 531

[56] References Cited

U.S. PATENT DOCUMENTS

| | | | |
|---|---|---|---|
| 2,726,920 | 12/1955 | Federkiel et al. | 8/515 |
| 3,118,723 | 1/1964 | Harding | 8/14 |
| 3,167,517 | 1/1965 | Millson et al. | 252/353 |
| 3,178,309 | 4/1965 | Harding | 8/173 |
| 3,377,130 | 4/1965 | Millson et al. | 8/54 |
| 3,493,981 | 2/1970 | Noda et al. | 8/94 |
| 3,619,124 | 11/1971 | Weckler et al. | 8/173 |
| 3,669,611 | 6/1972 | Shimauchi et al. | 8/613 |
| 3,781,169 | 12/1973 | Deubel et al. | 8/608 |
| 3,788,807 | 1/1974 | Beiertz | 8/552 |
| 3,845,113 | 10/1974 | Walz et al. | 8/589 |
| 3,933,424 | 1/1976 | Falkehag et al. | 8/608 |
| 3,993,439 | 11/1976 | Deubel et al. | 8/34 |

FOREIGN PATENT DOCUMENTS

| | | | |
|---|---|---|---|
| 1289733 | 4/1961 | France | 8/531 |
| 51-4380 | 1/1976 | Japan | 8/442 |
| 975307 | 11/1964 | United Kingdom | 8/442 |

*Primary Examiner*—Maria Parrish Tungol
*Attorney, Agent, or Firm*—Bailey, Dority & Flint

[57] ABSTRACT

A composition useful as a dyeing, fixing and leveling agent for acid dyestuffs on polyamide fibers, as a reserving agent in dyeing of polyamide-cellulosic blends with direct dyes and as an aftertreating agent for improving wet fastness and perspiration resistance of polyamides dyed with an acid dyestuff consists essentially of an aqueous solution of 60–85% by weight of solute of phenolsulfonic acid-formaldehyde condensate and 15–40% by weight of solute of an alkylene glycol of up to 3–10 carbon atoms or a polyoxyethylene or -thio glycol or molecular weight up to 1000.

9 Claims, No Drawings

TEXTILE TREATING COMPOSITION AND METHOD OF USE THEREOF

BACKGROUND OF THE INVENTION

This invention relates to a composition useful in the dyeing of fibers and fabrics containing a polyamide component.

PRIOR ART STATEMENT

Harding (U.S. Pat. No. 3,178,309) discloses treatment of wool and nylon with a combination of formadehyde-arylsulfonic acid condensate and a non-ionic dispersing agent derived from a fatty alcohol or fatty acid-ethylene oxide condensate in 1:2 ratio by weight to improve resistance to abrasion.

Millison et al, in U.S. Pat. Nos. 3,167,517 and 3,377,130, teach that a ternary combination of a condensate of an alkylphenol and ethylene oxide, a condensation product of polyoxypropylene and polyoxyethylene and an alkali metal salt of a sulfonated naphthalene, in which the weight ratio condensation products to sulfonated naphthalene is 1.5:1 to 10:1, is useful as a dyeing assistant for anionic dyes applied to nitrogenous fibers.

The use of arylsulfonic acid-aldehyde condensates in dyeing compositions is also disclosed in the following U.S. Pat. Nos.; Federkiel et al, 2,726,920; Harding, 3,118,723; and Deubel et al, 3,993,439. Weckler et al (U.S. Pat. No. 3,619,124) employ halogenated condensates of alkylene oxides and alcohols as dyeing auxiliaries.

None of the foregoing references discloses a composition containing a phenolsulfonic acid-formaldehyde condensate and a glycol which functions as fixing agent, leveling agent and reserving agent for polyamide fibers or fabrics or as an after-treating agent to improve wet fastness and resistance to perspiration of polyamide materials dyed with an acid dyestuff.

OBJECTS OF THE INVENTION

It is the object of the invention to provide a composition for the treatment of polyamide fibers which can be applied before dyeing to reserve the polyamide component of polyamide-cellulosic blends from dyeing with direct dyes, as a dyeing assistant to improve leveling and fixing of acid dyestuffs on polyamide fibers and fabrics and as an after-treating agent for polyamide substrates dyed with acid dyes to improve wet fastness and resistance to perspiration thereof.

SUMMARY OF THE INVENTION

In a compositional aspect, this invention relates to a textile-treating composition consisting essentially of an aqueous solution of 60–85% by weight of solute of phenolsulfonic acid-formadehyde condensate and 15–40% by weight of solute of an alkylene glycol of up to 3–10 carbon atoms or a polyoxyethylene or -thio glycol of molecular weight up to 1000.

In a method-of-use aspect, this invention relates to a method of dyeing polyamide fibers or fabrics and leveling and fixing acid dyes thereto comprising adding to a dye bath containing an acid dye a composition as above in an amount of 0.5–15% by weight of added solute and dyeing the polyamide fiber or fabric at the boil.

DETAILED DESCRIPTION

"Phenosulfonic acid-formaldehyde condensate," as used in the specification and claims, includes condensation products of formaldehyde with mono-, di- and trisulfonic acids of phenols, e.g., phenol or cresol. Exemplary materials are of the formula

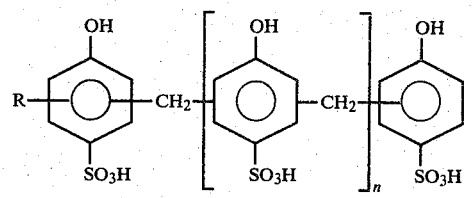

in which R can be H or methyl and n is 0, 1, 2, 3 or 4. Contemplated equivalents of phenolsulfonic acid condensates with formaldehyde include condensates with higher aldehydes and ketones such as benzoin or acetone.

Phenolsulfonic acid-formaldehyde condensates are commercially available under the names of Raycafix NYF (Rayca Chemical Co.), Cassofix N 13 (American Hoechst Corp.), Colofix NA (Colox Corop.) and Erional NW (Ciba-Geigy Corp.).

Alkylene glycols of 3–10 carbon atoms include propylene glycol, butylene glycol, hexylene glycol and the like.

"Polyoxyethylene glycol," or "polyethylene glycol," as used in the specification and claims, means a series of compounds of the formula $HO(CH_2CH_2O)_nH$, wherein n is at least 1. The molecular weight of these materials may go as high as 500,000 or one million or higher, but the preferred materials are lower molecular weight polyethylene glycols, especially those of molecular weight 62 (n is 1) through about 600 (PEG-600). Polyethylene glycols can be purchased from Union Carbide Corp., Dow Chemical Co., Jefferson Chemical Co., Olin Corporation, Celanese Chemical Co., The Ora Corporation and GAF Corporation.

"polythioglycol" or "thiodiglycol," as used in the specification and claims, means thio analogs of polyethylene glycol, i.e., compounds of the formula $H(O\ CH_2CH_2)S_n\ (CH_2CH_2O)\ H_n$ in which n is at least 1. Preferred materials are those of molecular weight from 122 (n is 1) to about 1000, which can be bought from The Ora Corporation or Alcolac Chemical Co.

"Polyamide," as used in the specification and claims includes various high-molecular weight polyamides, known generally as nylons. Typical of these materials is that identified as nylon 6, which is a self-condensation product of 6-aminohexanoic acid or the corresponding lactam. Another typical nylon is nylon 6,6, which is derived from hexamethylene diamine and adipic acid. Other exemplary polyamides are nylon 6,10 and a polyamide obtained from bis(p-aminocyclohexyl)methane and various aliphatic dicarboxylic acids, especially dodecanedioic acid.

"Acid dyes," as used in the specification and claims, are anionic dyes, which usually contain one or more strongly acidic groups such as the sulfonic radical, $R\text{-}SO_3^-$. Typical examples are C.I. Acid Red 151,

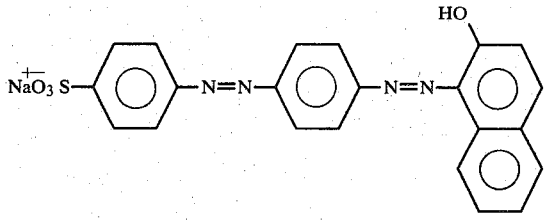

and C.I. Acid Red 66.

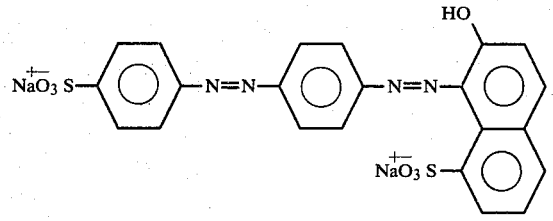

Acid dyes are commonly used to dye nitrogenous fibers such as nylon, wool and silk.

In a preferred method of use, the compositions of the invention are added to a dye bath containing an acid dyestuff and function as a leveling and fixing agent. The preferred technique is application at the boil, so as to aid level dyeing up to the boil and dye fixation at the boil. The amount of added composition will comprise 0.5–15% by weight of total added solute in the dyebath.

The compositions of the invention are aqueous solutions and will generally contain 10–60% by weight of added solute in a weight ratio of 60–85:40–15 of phenolsulfonic acid-formaldehyde condensate : polyoxyethylene or thio glycol. Therefore, if the compositions contain 50% by weight of solute, the amount of added solute in the dyebath at 0.5–10% by weight of the composition would be 0.25–5% by weight. Preferably, the amount of added solute in the dyebath is at the lower range of use, from 0.5–3% by weight.

During application of dyes by this technique, the dye bath is maintained on the acidic side, at pH 4–6. A pH of 4.5–5.5 is preferred and can be achieved by addition of acetic or other acids to the bath.

It will be appreciated that the technique of dyeing fibers or fabrics at the boil conventionally calls for preparation of a dyebath containing an acid dye, the composition of the invention and other additives at an elevated temperature, usually 100–140 degrees F., prior to entering the substrate being dyed into the bath. The temperature of the bath is gradually raised, typically at a rate of 2–4 degrees F./minute to 212 degrees F. and then held at this temperature for 45–90 minutes. The bath is cooled and the dyed substrate is removed, rinsed and dried.

In another embodiment, this invention relates to a method of reserving polyamide in a polyamide-cellulosic fiber or fabric blend from the action of a direct dye comprising treating the fiber or fabric, before dyeing with a direct dye, with a bath containing a composition as above in an mount of 0.5–15% by weight of added solute at 110–130 degrees F. for 10–30 minutes.

As used in the specification and claims, "reserve" means to prevent dyeing of nylon in a nylon-cellulosic mixture while the cellulosic component is dyed to the desired shade by the direct dye.

"Direct dye," as used in the specification and claims, means dyes which are applied directly to the fiber without a mordant. Directs are used to dye cotton, rayon, silk, linen and sometimes nylon. Direct dyes are chemically similar to acid dyes but have been reacted further to provide "direct" addition to cellulosics. Exemplary of a direct dye is C.I. Direct Red 79, which is represented by the structural formula

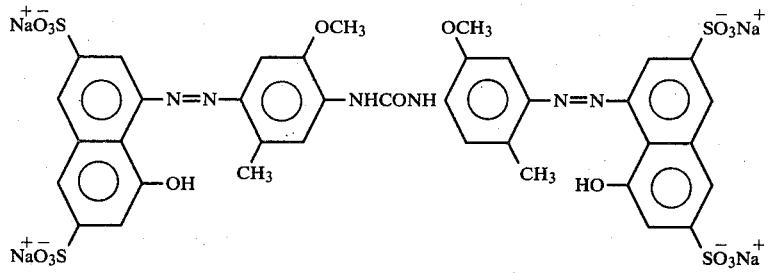

In another embodiment, the compositions of this invention can be used in an after-treatment of polyamides dyed with an acid dyestuff by adding to an exhausted dye bath from dyeing the polyamide fiber or fabric with an acid dyestuff a composition as above in an amount of 0.5–15% by weight of added solute, adjusting pH of the resulting bath to 4.5–5.5 and heating the polyamide fiber in the thus-produced bath at 180–200 degrees F. for 15–45 minutes. The after-treatment improves wet fastness and resistance to perspiration of the treated fabric.

DESCRIPTION OF A PREFERRED EMBODIMENT

One preferred composition in accordance with this invention is that wherein the flycol is polyethylene glycol of molecular weight from 62 to about 600. Another is that wherein the glycol is a polythio glycol of molecular weight from 122 to about 1000. Preferably, the ration of phenolsulfonic acid-formaldehyde condensate to glycol is 60–80 : 40–20.

The preferred method of use is in situ in a dyebath containing an acid dye, applied at the boil, and the preferred level of added solute is 0.50–3% by weight. Preferred compositions are as above.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever. In the following Examples, the temperatures are set forth uncorrected in degrees Fahrenheit; unless otherwise indicated, all parts and percentages are by weight.

EXAMPLE 1

A dyeing assistant was prepared from 35 parts by weight of phenolsulfonic acid-formaldehyde condensate Racafix NYF (Rayca Chemical Co.) and 20 parts by weight of thio diglycol, Orox TDG (The Ora Corporation) dissolved in 45 parts by weight of water by pre-dissolving the resinous condensate in the water and adding the thio diglycol. The resultant syrupy mixture is stirred until uniform. The resulting dark, reddish brown solution (55% solute) had a pH of 3.5.

EXAMPLE 2

(a) Dye bath containing 0.554% by weight of Neutral Acid Yellow B4RK, 0.3% by weight Neutral Acid Blue LGGL and 0.10% by weight of Nyliton Red BW was set at 80 degrees F. To this was added 2% by weight of ammonium sulfate (pH adjustment) and 2% by weight of the composition of Example 1. A 20-gram swatch of nylon carpet containing light, regular and deep dyeable fibers of type 845, 846 and 847, type 66 BCF yarn was entered into the bath, the temperature of which was raised to 212 degrees F. at a rate of 3 degrees/min. The bath was kept at the boil for one hour and then cooled to 100 degrees F. The swatch was removed from the batch, rinsed and dried. The dyeing was perfectly level and showed excellent differentiation.

The procedure of (a) was repeated, except that the material prepared in Example 1 was used at the following levels:

| | |
|---|---|
| (b) | 4% |
| (c) | 6% |
| (d) | 10% |

In each case, differentiation was excellent but dye exhaustion decreased as the amount of composition of Example 1 was increased.

The procedure of (a) was repeated, except the nylon carpet containing light, regular and deep dyeable nylon, type 66 was dyed with 2% ammonium sulfate and 2% by weight of a composition containing 35 parts phenolsulfonic acid-formaldehyde condensate and 65 parts water.

The carpet was perfectly level and showed excellent differentiation.

EXAMPLE 3

(a) Dye bath containing 0.2 grams of Acid Red 151 in 150 ml of water was heated to 80 degrees F. and a 10-gram swatch of texturized nylon, type 6 was entered therein. The dyed swatch, processed as in Example 2, was blotchy and uneven in appearance and commercially unacceptable.

The swatch was subjected to the IIA Wash Text (AATCC Test Method 61-1972) as a result of which color bled into the wash liquor and stained the attached test rider badly.

(b) Similar results were obtained using a dye bath as in (a), except that 0.25 gram of Acid Green 25 was used.

EXAMPLE 4

Compositions were made as in Example 1 from phenol-sulfonic acid-formaldehyde condensate, glycol and water. The composition (0.4 gram) was added to a dye bath of 15 ml of 1% solution of Acid Blue 113 and two drops of acetic acid. The bath was heated to 80 degrees F. and a 10 gram swatch of stretch nylon 6,6 was entered therein. The temperature of the bath was raised to 212 degrees F. and maintained at the boil for 40 minutes. The bath was cooled and the dyed swatch was removed, rinsed and dried.

The following compositions were evaluated:

| | a | b | c | d | e | f | g | h | i | j |
|---|---|---|---|---|---|---|---|---|---|---|
| Water | 45 | 45 | 45 | 45 | 45 | 45 | 45 | 45 | 45 | 45 |
| Phenolsulfonic acid formaldehyde condensate | 35 | 35 | 35 | 35 | 35 | 35 | 35 | 35 | 35 | 35 |
| Diethylene glycol | 20 | | | | | | | | | |
| Ethylene gylcol | | 20 | | | | | | | | |
| Triethylene glycol | | | 20 | | | | | | | |
| Hexylene glycol | | | | 20 | | | | | | |
| Polyethylene glycol, 200 MW | | | | | 20 | | | | | |
| Polyethylene glycol, 400 MW | | | | | | 20 | | | | |
| Polyethylene glycol, 600 MW | | | | | | | 20 | | | |
| Propylene glycol | | | | | | | | 20 | | |
| Thiodiglycol | | | | | | | | | 20 | |
| POE (10) thiodiglycol | | | | | | | | | | 20 |

All dyeings were level and dye fixation was good. Each dyed swatch was subjected to the IIA wash test identified in Example 3(a). Wash fastness was of acceptable commercial quality, i.e., color change of the dyed swatch was negligible, class 4–5 on the Gray Scale for color change and staining on the attached multifiber test fabric rider was class 4–5 on the Gray Scale for staining. This test as described in AATCC Test Method 61-1972 is equivalent to five home machine launderings.

EXAMPLE 5

Dye baths were prepared as in Example 4(a), except that the amount of additive was varied as indicated. The dyed swatches were evaluated by the IIA wash fastness test and for colorfastness to perspiration (AATCC Test Method 15-1973). The following results were obtained:

| Additive % | Levelness of Dyeing | % Yield | IIA Wash Fastness (a) | Perspiration (b) |
|---|---|---|---|---|
| 0 | Good | Excellent | 1 | 1 |
| 0.5 | Excellent | Excellent | 2 | 2 |
| 1.0 | Excellent | Excellent | 3 | 3 |
| 2.0 | Excellent | Excellent | 4 | 4 |
| 4.0 | Excellent | Excellent | 4 | 5 |
| 6.0 | Excellent | Excellent | 5 | 5 |
| 8.0 | Excellent | Good | 5 | 5 |
| 10.0 | Excellent | Fair | 5 | 5 |

(a) Ratings per AATCC 61-1972 Rating 1 - substantial stain, Rating 5 - negligible stain.
(b) Ratings per AATCC 15-1973 Ratings 1 - substantial color transfer Rating 5 - negilgible color transfer

EXAMPLE 6

Composition prepared as in Example 1 from 40 parts by weight phenolsulfonic acid-formaldehyde condensate, 10 parts by weight ethylene glycol and 50 parts by weight water is used to reserve nylon during application of direct colors to cellulose fibers. The bath containing 1–4% by weight of additive is set at 120 degrees F., whereupon the nylon-cellulosic blend fiber of fabric is entered therein and the bath is kept at 120 degrees F. for 15–20 minutes. Predissolved direct dyes are added and the bath is circulated for 5 minutes. After addition of 5% by weight of NaCl, the bath temperature is raised to 190 degrees F. and held at that temperature for 20 minutes. Sodium chloride, in the amount of 25% by weight is added in three portions at 10-minute intervals. The temperature of the bath is raised to 200 degrees F. and kept at that temperature for 30 minutes. After cooling the bath to 160 degrees F., the bath is dropped to permit removal of the blended specimen, which is rinsed and dried.

EXAMPLE 7

Aftertreatment of nylon substrates dyed with acid dyes to improve wet fastness and resistance to perspiration is done by removing the dyed substrate from the exhausted dyebath and rinsing. To the dyebath, set at 120 degrees F. is added 2–4% by weight of a product prepared as in Example 1 from 35 parts by weight phenolsulfonic acid-formaldehyde condensate, 20 parts by weight of diethylene glycol and 45 parts by weight of water and 1–3% by weight of acetic acid to pH 5. The substrate is entered into the bath, which is heated to 190 degrees F. and maintained at 190 degrees F. for 20–30 minutes. The bath is dropped so that the substrate can be removed and rinsed. Softening of the substrate with an aqueous solution containing a cationic fatty acid inidazoline or polyethylene or a nonionic fatty ethexylate by exhausting onto the fiber for 20–30 minutes at 120–140 degrees F. is optional.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A method for uniform dyeing of polyamide fibers or fabrics and leveling and fixing acid dyes thereto comprising adding to a dye bath containing an acid dye a composition consisting essentially of an aqueous solution of 60–85% by weight of solute of phenolsulfonic acid-formaldehyde condensate and 15–40% by weight of solute of an alkylene glycol of up to 3–10 carbon atoms or a polyoxyethylene or -thio glycol of molecular weight up to 1000, in an amount of 0.5–15% by weight of added solute and dyeing the polyamide fiber or fabric at the boil.

2. The method of claim 1, wherein the composition contains polyethylene glycol of molecular weight from 62 to about 600.

3. The method of claim 1, wherein the composition contains polythioglycol of molecular weight from 122 to about 1000.

4. A method of reserving polyamide in a polyamide-cellulosic fiber or fabric blend from the action of a direct dye comprising treating the fiber of fabric, before dyeing with a direct dye, with a bath containing a composition consisting essentially of an aqueous solution of 60–85% by weight of solute of phenolsulfonic acid-formaldehyde condensate and 15–40% by weight of solute of an alkylene glycol of up to 3–10 carbon atoms or a polyoxyethylene or -thio glycol of molecular weight up to 1000, in an amount of 0.5–15% by weight of added solute at 110°–130° F. for 10–30 minutes.

5. The method of claim 4, wherein the glycol is polyethylene glycol of molecular weight from 62 to about 600.

6. The method of claim 4, wherein the glycol is a polythioglycol of molecular weight from 122 to about 1000.

7. A method of improving wet fastness and resistance to perspiration of polyamide fibers dyed with an acid dyestuff, comprising adding to an exhausted dye bath from dyeing the polyamide fiber or fabric with an acid dyestuff a composition consisting essentially of an aqueous solution of 60–85% by weight of solute of phenolsulfonic acid-formaldehyde condensate and 15–40% by weight of solute of an alkylene glycol of up to 3–10 carbon atoms or a polyoxyethylene or -thio glycol of molecular weight up to 1000, in an amount of 0.5–15% by weight of added solute, adjusting pH of the resulting bath to 4.5–5.5 and heating the polyamide fiber in the thus-produced bath at 180°–200° F. for 15–45 minutes.

8. The method of claim 7, wherein the glycol is a polyethylene glycol of molecular weight from 62 to about 600.

9. The method of claim 7, wherein the glycol is a polythioglycol of molecular weight from 122 to about 1000.

* * * * *